US006257435B1

(12) United States Patent
Chedister et al.

(10) Patent No.: US 6,257,435 B1
(45) Date of Patent: Jul. 10, 2001

(54) TAMPER EVIDENT CLOSURE MEMBER

(75) Inventors: Matthew O. Chedister, Corona; Larry E. Lathrum, Tustin, both of CA (US)

(73) Assignee: King Plastics, Inc., Orange, CA (US)

( * ) Notice: Subject to any disclaimer, the term of this patent is extended or adjusted under 35 U.S.C. 154(b) by 0 days.

(21) Appl. No.: 09/481,339

(22) Filed: Jan. 12, 2000

(51) Int. Cl.[7] ..... B65D 43/00

(52) U.S. Cl. ..... 220/276; 220/266; 220/792

(58) Field of Search ..... 220/276, 270, 220/265, 266, 792

(56) References Cited

U.S. PATENT DOCUMENTS

| | | | | |
|---|---|---|---|---|
| D. 243,231 | | 2/1977 | Smith . | |
| D. 256,672 | | 9/1980 | Beck . | |
| D. 311,140 | | 10/1990 | Nelson . | |
| 3,420,397 | | 1/1969 | Miller . | |
| 3,425,592 | | 2/1969 | Vogel . | |
| 3,465,910 | | 9/1969 | Richie . | |
| 3,753,511 | | 8/1973 | Ruch . | |
| 3,773,207 | | 11/1973 | Dokoupil et al. . | |
| 3,866,784 | | 2/1975 | Beck . | |
| 3,899,097 | | 8/1975 | Aichinger . | |
| 3,955,742 | | 5/1976 | Marshall et al. . | |
| 3,964,635 | | 6/1976 | Ludder . | |
| 3,979,003 | | 9/1976 | Allen . | |
| 4,006,839 | | 2/1977 | Thiel et al. . | |
| 4,027,775 | | 6/1977 | Mygatt, Jr. et al. . | |
| 4,033,472 | | 7/1977 | Aichinger . | |
| 4,037,748 | | 7/1977 | Stubbs, Jr. . | |
| 4,190,175 | | 2/1980 | Allen . | |
| 4,212,409 | | 7/1980 | Jeppsson . | |
| 4,244,479 | | 1/1981 | Smalley . | |
| 4,252,248 | | 2/1981 | Obrist et al. . | |
| 4,345,692 | | 8/1982 | Obrist et al. . | |
| 4,347,943 | * | 9/1982 | Hackwell et al. | 220/792 |
| 4,349,174 | | 9/1982 | Obrist et al. . | |
| 4,350,263 | | 9/1982 | Hoffman . | |
| 4,433,793 | | 2/1984 | Ingemann . | |
| 4,480,761 | | 11/1984 | Aichinger . | |
| 4,487,329 | | 12/1984 | Winstead . | |
| 4,488,658 | | 12/1984 | Smith et al. . | |
| 4,488,676 | | 12/1984 | Halliday . | |
| 4,664,279 | | 5/1987 | Obrist et al. . | |
| 4,682,706 | | 7/1987 | DeVore et al. . | |
| 4,732,293 | | 3/1988 | Landis . | |
| 4,735,337 | * | 4/1988 | Von Holdt | 220/276 X |
| 4,934,554 | * | 6/1990 | Edwards . | |
| 5,042,680 | | 8/1991 | Argudo et al. . | |

(List continued on next page.)

OTHER PUBLICATIONS

Photograph of a closure member manufactured by Berry Plastic Corporation before the filing date of the instant application.
Photograph of a closure member manufactured by Berry Plastic Corporation before the filing date of the instant application.
Photograph of a closure member manufactured by Berry Plastic Corporation before the filing date of the instant application.

(List continued on next page.)

*Primary Examiner*—Steven Pollard
(74) *Attorney, Agent, or Firm*—Knobbe, Martens, Olson and Bear, LLP

(57) ABSTRACT

A tamper evident closure member having tamper-evident breakaway strips and correctly spaced reinforced pull-tabs allowing a user to remove the closure member and separate the breakaway strips from a container by lifting the closure member at one of the pull-tabs. The closure member is configured such that the removal and separation happen in a single motion. Moreover, the tamper evident closure member includes engaging walls having a different angle than that of a rim of a container, thereby assisting in complete removal of the breakaway strips during the single motion separation. The closure member also includes vertical indicators providing enhanced tamper resistance.

18 Claims, 6 Drawing Sheets

U.S. PATENT DOCUMENTS

| | | | | |
|---|---|---|---|---|
| 5,115,934 | | 5/1992 | Nelson . | |
| 5,249,694 | | 10/1993 | Nelson . | |
| 5,592,766 | | 1/1997 | Mygatt . | |
| 5,617,968 | * | 4/1997 | Luburic | 220/266 X |
| 5,730,309 | * | 3/1998 | Jiradejnunt et al. | 220/276 |
| 5,788,107 | | 8/1998 | Meyer et al. . | |
| 5,873,484 | * | 2/1999 | Clute | 220/276 |
| 5,931,332 | | 8/1999 | Mygatt et al. . | |

OTHER PUBLICATIONS

Photograph of a closure member manufactured by Berry Plastic Corporation before the filing date of the instant application.

Photograph of a closure member manufactured by Berry Plastic Corporation before the filing date of the instant application.

Photograph of a closure member manufactured by Berry Plastic Corporation before the filing date of the instant application.

Photograph of a closure member manufactured by Berry Plastic Corporation before the filing date of the instant application.

Photograph of a closure member manufactured by Berry Plastic Corporation before the filing date of the instant application.

Photograph of a closure member manufactured by Berry Plastic Corporation before the filing date of the instant application.

Photograph of a closure member manufactured by Berry Plastic Corporation before the filing date of the instant application.

Photograph of a closure member manufactured by Berry Plastic Corporation before the filing date of the instant application.

Photograph of a closure member manufactured by Berry Plastic Corporation before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

Photograph of a closure member manufactured by Hi Plas before the filing date of the instant application.

* cited by examiner

TAMPER EVIDENT CLOSURE MEMBER

BACKGROUND OF THE INVENTION

1. Field of the Invention

The present invention relates in general to packaging containers, and more particularly to a tamper evident closure member, or lid, for a container.

2. Description of the Related Art

In today's retail market, producers of consumer products package a wide number of items in reclosable containers. In particular, producers use reclosable containers to package almost every conceivable food or perishable product. However, a significant danger from accidental or malicious tampering exists when using reclosable containers for such products. Accordingly, producers have developed a wide number of reclosable containers having tamper indication mechanisms for protecting unknowing consumers from these tamper-related dangers. For example, a typical tamper indication mechanism is a lid having a removably attached ring. If the ring is broken, the consumer will know that the contents of the container may be compromised.

However, using the ring to indicate tampering has a variety of drawbacks. For example, the consumer may have to use multiple steps to remove the ring. An example of this is found in U.S. Pat. No. 4,682,706, issued to DeVore et al. on Jul. 28, 1987, disclosing a lid where the consumer first must circumferentially tear off the ring before removing the lid. Other tamper-evident rings require consumers to independently pull multiple tabs or entire ring sections before they are able to remove the lid. Such machinations reduce the desirability and aesthetics of the reclosable container and may force the producer to have to choose between aesthetic functionality and consumer safety.

Furthermore, tamper-evident lids often should satisfy several other design criteria. For example, typically the lid is made from a single injection mold, thereby requiring straightforwardness in lid design. Also, the producer may package the contents of the container in an assembly-line type setting where a high speed capping machine separates each lid and engages it with a newly filled container. Often, these high-speed capping machines also dictate straightforwardness in lid design.

Accordingly, a need exists for a safe, aesthetically pleasing, tamper-evident, reclosable lid having a design that is straightforward enough to be made from a single injection mold, to be used in a high speed capping system, and to be easily removed from the container.

SUMMARY OF THE INVENTION

Accordingly, one aspect of the present invention is to provide a tamper evident closure member, or lid, incorporating single motion separation along with the safety feature of tamper indication. In other words, the closure member may be advantageously separated from the container by the single motion of pulling up on a pull-tab. Moreover, according to this aspect, the structure of the tamper evident closure member is of sufficient straightforwardness that it may be manufactured from a single mold injection and used in a high speed capping machine.

According to another aspect, the tamper evident closure member includes an inner engaging wall engaging a rim of the container at an angle of that advantageously increases the interference fit, or attachment, between the container and the closure member, thereby making undiscovered tampering more difficult. According to another aspect, the closure member includes vertical indicators comprising weakened sections near reinforced pull-tabs, thereby advantageously increasing the likelihood of a noticeable tamper-indicating discontinuity.

According to another aspect, the tamper evident closure member includes a frangible web between a skirt and a plurality of breakaway strips. A plurality of reinforced pull-tabs are circumferentially spaced about the lid between the breakaway strips. The frangible web advantageously promotes single motion separation of the lid from the container, preferably during which the breakaway strips automatically separate from the skirt. According to yet another aspect, the pull-tabs also function to reclose or reseal the closure member to container after the breakaway strips are separated.

Therefore, one aspect of the present invention is a closure member comprising a center section configured to cover a container, a skirt surrounding the center section, a plurality of non-continuous breakaway strips, and a frangible web for attaching the skirt to the breakaway strips. The closure member also includes a plurality of pull-tabs formed on the skirt. Each pull-tab is positioned between adjacent breakaway strips. The closure member also includes at least one protruding edge on each of the breakaway strips. The protruding edge is configured to provide single motion separation of the breakaway strips from the skirt when one of the pull-tabs is lifted upwardly.

Another aspect of the present invention is a reclosable container comprising a container having an inverted U-shaped annular rim terminating at a tip, and a lid. The lid has a center section, a skirt formed at the periphery of the center section and configured to engage the rim of the container, and a plurality of strips frangibly attached to the skirt. Each strip includes an inner edge configured to engage the tip of the rim such that a single motion separates the skirt from the strips and the lid from the container.

Another aspect of the present invention is a method of packaging goods in a reclosable container. The method comprises filling a container with goods and attaching a closure member having a tamper evidencing mechanism to the container in a manner that provides removal of the closure member from the container along with separation of tamper evidencing mechanism from the closure member in a single motion.

Yet another aspect of the present invention is a method of separating a lid from a container. This method comprises lifting a tab on the periphery of a lid such that the lid completely disengages from a container in a single motion. Moreover, at least one tamper resistant strip is also separated from the lid and the container in the same single motion.

Another aspect of the present invention is a closure member comprising a cover section configured to cover an open end of a container, and a skirt surrounding the cover section. The skirt has a plurality of pull-tabs circumferentially spaced around the periphery of the skirt. Each pull-tab is of a thicker cross section than that of the skirt and each pull-tab has at least one protrusion configured to engage an edge of an a rim of a container so as to attach the closure member to the container.

Another aspect of the present invention is a reclosable container comprising a first surface on a skirt of a closure member. The skirt has a cross section shaped substantially like an inverted letter U. The reclosable container further includes a second surface on a rim of a container. The rim of the container has a cross section shaped substantially like the skirt. The first surface forms a first angle with a vertical plane and the second surface forms a second angle with the vertical plane. Moreover, the second angle is greater than the first angle.

Yet another aspect of the present invention is a closure member comprising a center section configured to cover an open end of a container. The open end of the container terminates in an outermost tip. The closure member also includes a skirt surrounding the center section and having an inverted U-shaped cross section. The inverted U-shaped cross section has a first wall connected to the center section and a second wall opposite the first wall. The closure member also includes at least one pull-tab attached the second wall and at least one breakaway strip adjacently attached to the pull-tab via vertical indicators and attached to the skirt via a perforated web. The breakaway strip has a first protrusion configured to engage the container at the outermost tip such that the vertical indicators, the perforated web, and the breakaway strips form a tamper evidencing mechanism.

Another aspect of the present invention is a closure member comprising a center section configured to cover an open end of a container, a skirt surrounding the center section, a plurality of breakaway strips configured to prevent tampering, and a plurality of weakened sections. Each weakened section frangibly connects at least a portion of each the breakaway strip to the skirt. The closure member also includes at least one pull-tab. The pull-tab is fixedly attached to the skirt and frangibly attached between breakaway strips such that a user lifting on the pull-tab separates the closure member from the container in a single motion.

For the purposes of summarizing the invention, certain aspects, advantages and novel features of the invention have been described. Of course, it is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

Other aspects and advantages of the invention will be apparent from the detailed description below and the appended claims.

BRIEF DESCRIPTION OF THE DRAWINGS

The present invention is described in more detail below in connection with the attached drawings, which are meant to illustrate and not to limit the invention, and a brief description of which is as follows.

DETAILED DESCRIPTION OF THE PREFERRED EMBODIMENT

Figure 1:
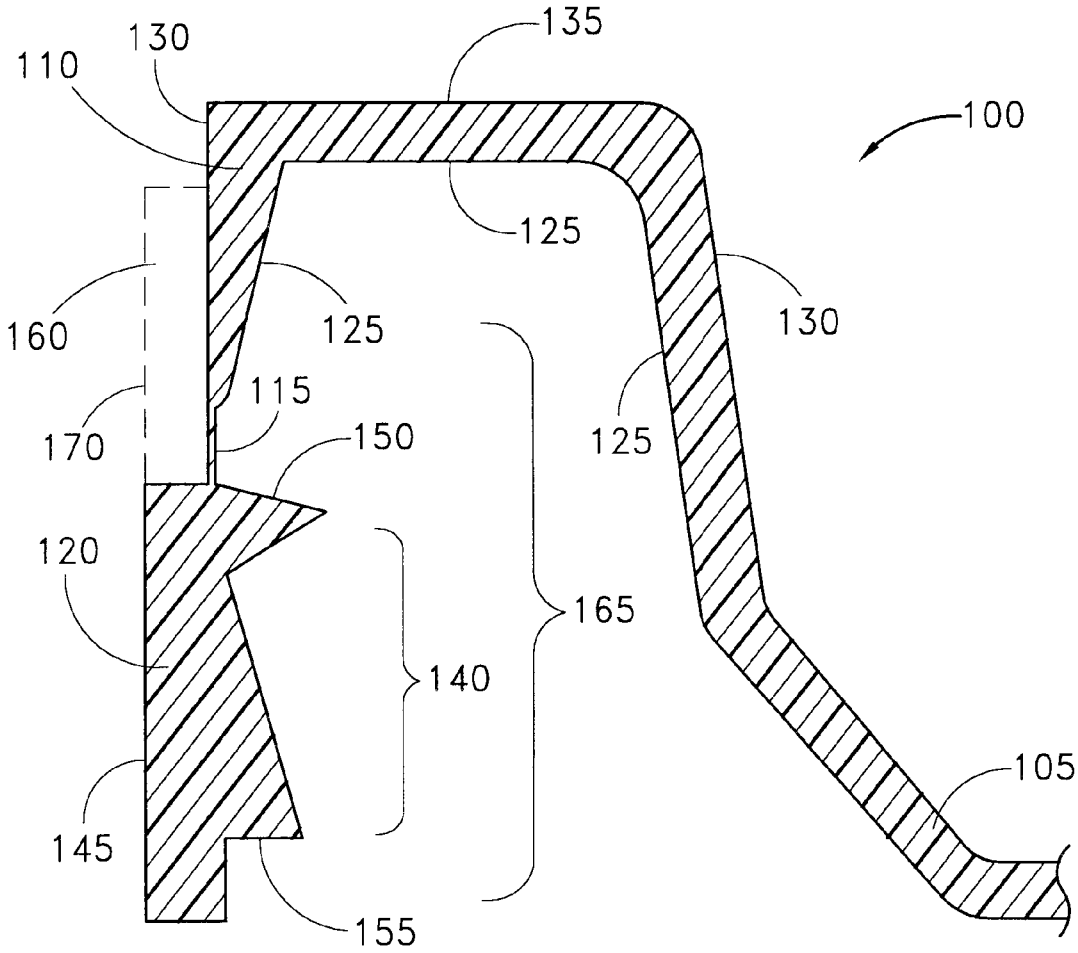
FIG. 1 illustrates a cross-sectional side view of a closure member according to one embodiment of the invention.

FIG. 1 illustrates a cross-sectional side view of a tamper evident closure member 100 according to one embodiment of the invention. As shown in FIG. 1, the closure member 100 comprises a center section 105, a skirt 110, a perforated web 115, and a breakaway strip 120. According to the preferred embodiment, the center section 105 is generally planar, of unitary construction, and configured to cover an opening at the top of a container. In addition, the center section 105 may include a wide variety of inner angles, indentations, ridges, and the like. Such construction of the center section 105 advantageously allows a plurality of containers to be efficiently and sturdily stacked or stored on top of one another.

The skirt 110 surrounds the center section 105 of the closure member 100. According to the preferred embodiment, the skirt 110 comprises an inner surface, called an engaging wall 125, and an outer surface, called an outer wall 130. The engaging wall 125 forms a bight or inverted letter "U" shaped cross section with one end of the inverted U-shaped cross section attaching to the container-facing side of the center section 105. According to the preferred embodiment, the outer wall 130 is shaped substantially similar to the engaging wall 125 with one end of the inverted U-shaped cross section attaching to the center section 105 on the side facing opposite the container. Moreover, the outer wall 130 includes a middle section forming a raised annular rim-shaped top surface 135. Based on the foregoing, the skirt 110 is configured to assist in attaching the closure member 100 to the container.

It will be understood that a skilled artisan will recognize a wide number of structures for the skirt 110 that assist in attaching the closure member 100 to the container.

FIG. 1 also illustrates the breakaway strip 120 attached to the skirt 110 by way of the perforated web 115. The perforated web 115 is preferably frangible and comprises weakened sections 137 circumferentially alternating with open sections 138. The weakened sections 137 are preferably thin relative to the skirt 110 such that when stress is applied to the skirt 110, the skirt 110 separates from the breakaway strip 120 at the weakened sections 137. The open sections 138 comprise gaps or spaces between the weakened sections 137. Thus, only a very small force is required to separate the breakaway strip 120 from the skirt 110 at the perforated web 115. This ease of separation enhances both the aesthetic value and tamper resistance of the closure member 100. The aesthetic value of the closure member 100 is enhanced because easy separation of the breakaway strip 120 from the skirt 110 allows for the separation to occur in a single motion, as will be further discussed below. The tamper resistance of the closure member 100 is enhanced because even a small tampering force will still be indicated by the separation of the breakaway strip 120.

As shown in FIG. 1, the breakaway strip 120 includes an inner surface 140 facing radially inward toward the container. The breakaway strip 120 also includes an outer surface 145 opposite that of the inner surface 140. The inner surface 140 includes an upper protrusion 150 and a lower protrusion 155 such that the inner surface 140 roughly forms a sawtooth-like structure. The upper protrusion 150 provides a locking and tamper evidencing mechanism, as explained below. The lower protrusion 155 relates to the stacking and spacing of the closure member 100 on high-speed capping mechanisms. For example, a typical capping mechanism functions to attach the closure member 100 to a filled container. In order to do this at a relatively high speed, the capping mechanism maintains a plurality of the closure members 100 in a stack at a first location, and feeds one of the closure members 100 from the stack at a time. The lower protrusion 155 ensures that the closure members 100 within the stack will not "stick" together. For example, the lower protrusion 155 advantageously blocks the top surface 135 of a subsequent closure member 100 from sliding into a locked position inside the breakaway strip 120.

The outer surface 145 comprises a substantially vertical wall. Moreover, in the preferred embodiment, the perforated web 115 is approximately centered between the innermost portion of the inner surface 140 and the outermost portion of the outer surface 145.

However, it will be understood that a skilled artisan would recognize that the perforated web 115 may advantageously attach to the breakaway strip 120 in a wide number of areas. For example, the perforated web 115 may attach to the breakaway strip 120 anywhere from approximately the innermost portion of the inner surface 140, thereby leaving only a small edge for the upper protrusion 150, to the outermost portion of the outer surface 145.

The closure member 100 also includes at least one and preferably three pull-tabs 160, shown in FIG. 1 partially in phantom because each pull-tab 160 circumferentially alternates with the perforated web 115 and the breakaway strip 120. Thus, the structure of the pull-tab 160 includes the structures shown in phantom and those associated with the breakaway strip 120.

According to the preferred embodiment, the pull-tab 160 is a reinforced extension of the skirt 110, in that rather than the skirt 110 tapering down in thickness to the perforated web 115, the skirt 110 widens in thickness at the pull-tab 160. Moreover, the pull-tab 160 includes an inner surface 165 and an outer surface 170. The outer surface 170 is similar in shape to the outer surface 145 of the breakaway strip 120 except that the outer surface 170 of the pull-tab 160 extends vertically to approximately the top surface 135 of the skirt 110. Moreover, the inner surface 165 of the pull-tab 160 is similar in shape to the inner surface 140 of the skirt 110, in that the inner surface 165 of the pull-tab 160 includes structures similar to the upper and lower protrusions, 150 and 155, respectively.

Figure 2:
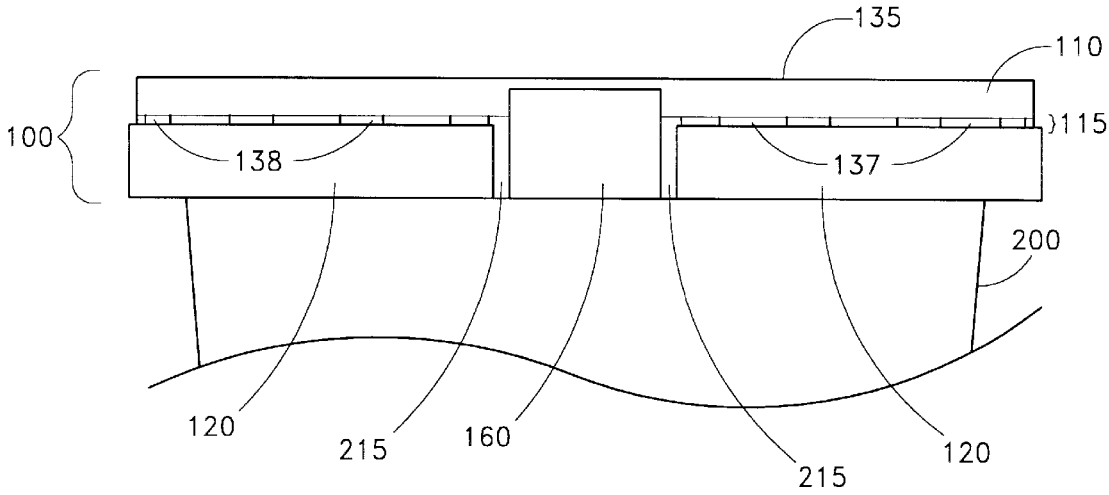
FIG. 2 illustrates a front elevation view of the closure member of FIG. 1, engaged to a container.

FIG. 2 illustrates a front elevational view of the closure member 100 engaged to a container 200 according to the preferred embodiment of the invention. As shown in FIG. 2, the closure member 100 includes the skirt 110 having the top surface 135. In addition, FIG. 2 shows the breakaway strip 120 attached to the skirt 110 by way of the perforated web 115. As discussed in the foregoing, the perforated web 115 preferably includes the weakened sections 137 (not shown) alternating with open sections 138 (not shown) advantageously providing separation when even only a small force is applied.

However, it will be understood by one of ordinary skill in the art that the perforated web 115 may include a wide number of structures configured to break when stress is applied to the skirt 110. For example, the perforated web 115 may only include the weakened sections 137. Alternatively, the perforated web 115 may comprise vertical grooves spaced apart so as to break when stress is applied.

FIG. 2 also illustrates a front elevational view of the pull-tab 160. As shown in FIG. 2, the pull-tab 160 is surrounded on both sides by vertical indicators 215, and firmly connected to the skirt 110 near the top surface 135. The vertical indicators 215 comprise thinned material similar to the weakened sections 137. Accordingly, if accidental or malicious tampering occurs, the vertical indicators 215 advantageously provide weakened material adjacent to reinforced material on the pull-tab 160, thereby providing the consumer with a likely area for such tampering to be indicated by a break or discontinuity.

Moreover, the pull-tab 160 provides additional advantageous functionality. For example, when stress is applied to the pull-tab 160 in an outwardly lever-type fashion, the pull-tab 160 hinges at the skirt 110 near the top surface 135 while breaking though the vertical indicators 215. Such lever-action being located near the top surface 135 of the skirt 110 advantageously transfers the stress to the closure member 100, thereby easily peeling the skirt 110 up and away from the container 200 in a single motion.

Figure 3:
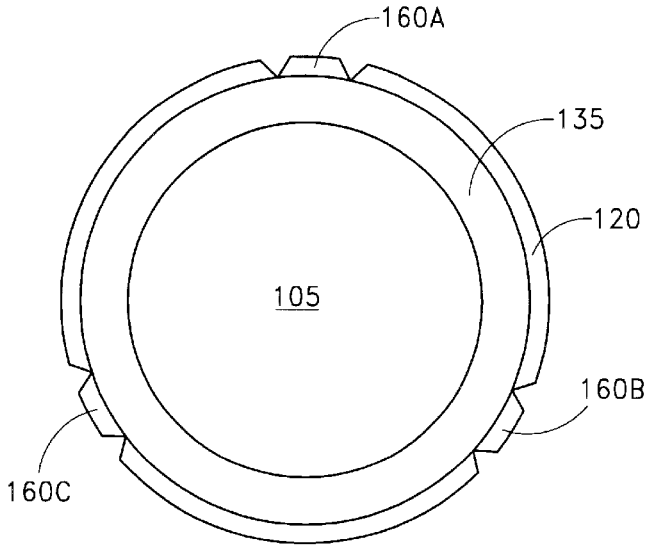
FIG. 3 illustrates a top view of a closure member according to FIG. 1.

FIG. 3 illustrates a top view of the closure member 100 according to the preferred embodiment of the invention. As shown in FIG. 3, the closure member 100 includes the center section 105, circumferentially surrounded by the top surface 135 of the skirt 110. According to this embodiment, three pull-tabs, 160A, 160B, and 160C are approximately evenly spaced and attached around the edge of the skirt 110. One breakaway strip 120 is connected between each of the pull-tabs 160. Such configuration of the pull-tabs 160 and the breakaway strip 120 advantageously provides multiple points along the periphery of the closure member 100 where stress may be applied to remove the closure member 100 from the container 200.

Figure 4:
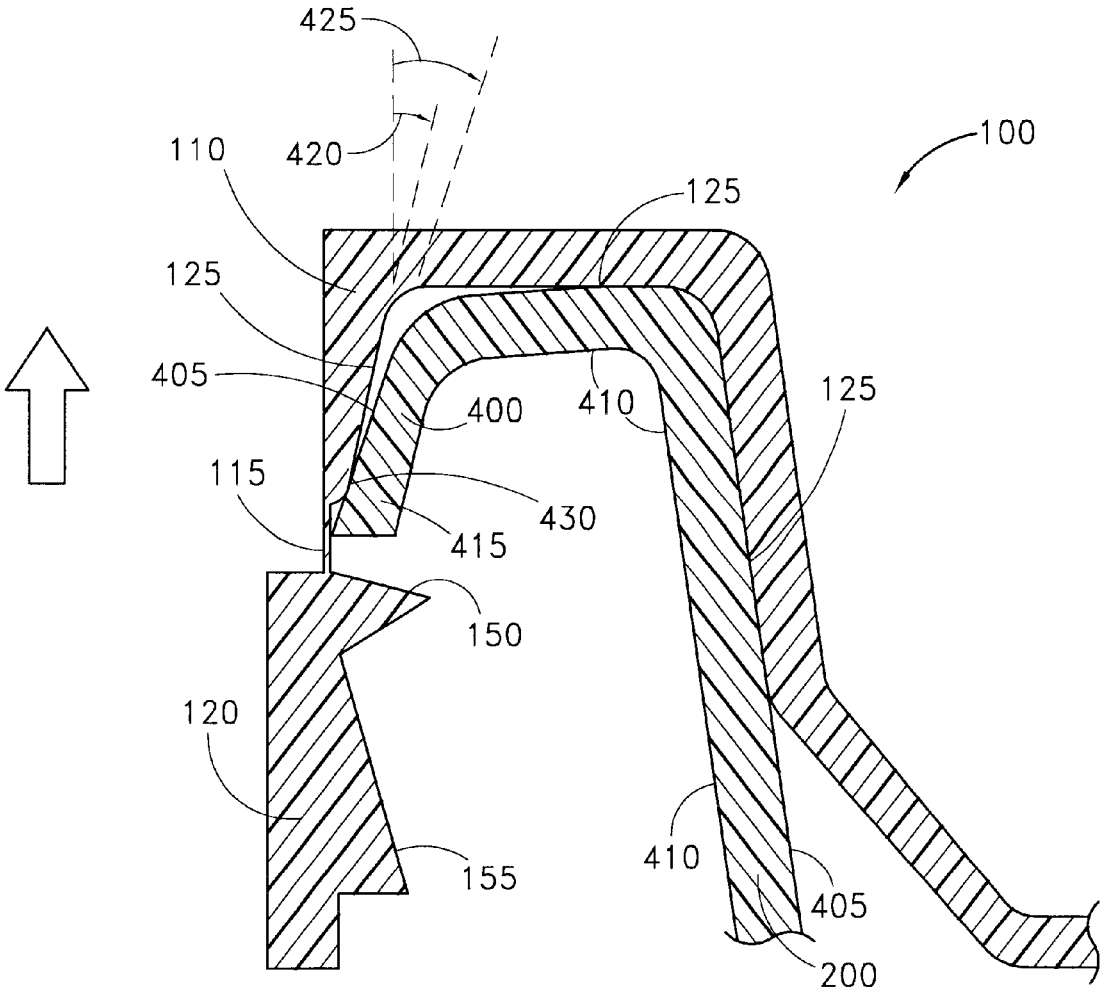
FIG. 4 illustrates a cross-sectional side view of the closure member engaged with the container of FIG. 2.

FIG. 4 illustrates a cross-sectional side view of the closure member 100 engaged to the container 200, according to the preferred embodiment of the invention. As shown in FIG. 4, the container 200 includes an inverted U-shaped annular rim 400 having an inner surface 405, so named because the extension of the inner surface 405 is also the surface corresponding to the inside of the container 200. The annular rim 400 also includes an outer surface 410, so named because the extension of the outer surface 410 is the surface corresponding to the outside of the container 200.

According to the preferred embodiment, the inner surface 405 is shaped substantially like the engaging wall 125 of the skirt 110. According to this embodiment, the rim 400 and the engaging wall 125 form a friction fit relationship such that the closure member 100 can be re-used to cover the container 200 and form a seal even after the breakaway strip 120 is removed.

FIG. 4 also illustrates the advantageous relationship between an annular tip 415 at the extremity of the rim 400 and the breakaway strip 120. For example, according to this embodiment, as the closure member 100 is first engaged to cover the container 200, the breakaway strip 120 hinges outwardly at the perforated web 115 such that the upper and lower protrusions, 150 and 155, on the inner surface 140 of the breakaway strip 120 slide around the inner surface 405 of the rim 400. Once the annular tip 415 is pushed beyond the upper protrusion 150, the breakaway strip 120 hinges back toward the outer surface 410 of the container 200. Thus, the perforated web 115 advantageously allows the breakaway strip 120 to flex to a larger diameter and snap over the annular tip 415 of the rim 400 of the container 200.

Moreover, once the breakaway strip 120 has snapped over the rim 400, the upper protrusion 150 of the breakaway strip 120 advantageously promotes the tamper indicating aspect of the closure member 100. For example, once the closure member 100 is engaged to the container 200, any attempt to lift the closure member 100 off the container 200 engages the annular tip 415 of the container 200 with the upper protrusion 150 on the breakaway strip 120. The engagement of the annular tip 415 and the upper protrusion 150 applies stress to the perforated web 115 and the vertical indicators 215. Any further lifting of the closure member 100 or prying under the breakaway strip 120 will exert enough force onto one or all of the vertical indicators 215 or weakened sections 137 to cause either visible damage or a tamper indicating break therein. Accordingly, the closure member 100 cannot be removed and the interior of the container 200 cannot be accessed without removal of at least a portion of the breakaway strip 120 or some other visible damage to the closure member 100.

According to the preferred embodiment of the invention, the outermost side of the engaging wall 125 advantageously forms a first angle 420 with a vertical plane. Moreover, the outermost side of the inner surface 405 of the container 200 forms a second angle 425 with the same vertical plane. As shown in FIG. 4, the first angle 420 is greater than the second angle 425 such that the engaging wall 125 has a natural tendency to try to lift or raise the closure member 100 off the container 200.

Such natural tendency in the structures provides several distinct advantages. For example, before the container 200 has first been opened, i.e., before the breakaway strip 120 has been separated from the skirt 110, the lifting tendency raises the closure member 100 until the upper protrusion 150 engages the annular tip 415. Thus, the upper protrusion 150 locks the closure member 100 onto the container 200. This locking advantageously decreases the likelihood that any accidental or malicious tampering can go undetected. Moreover, this locking advantageously increases the ease of separation between the skirt 110 and the breakaway strip 120. Both of these advantages stem from the relatively small force needed to separate the breakaway strip 120 from the skirt 110. The more force produced from the foregoing lifting tendency, the less additional force will be needed to separate the breakaway strip 120.

In addition to the foregoing, the lifting tendency also enables the reclosure or resealing of the closure member 100 to the container 200. For example, the after the initial opening, i.e., after the breakaway strip 120 has been separated from the skirt 110, the upper protrusion 150 found on the inner surface 165 of the pull-tabs 160 catches the annular tip 415. Thus, after the initial opening, the upper protrusion 150 locks the closure member 100 onto the container 200 through the pull-tabs 160.

In addition to the advantages in locking and reclosure provided by the steeper angled engaging wall 125, the differing angles between the outermost side of the engaging wall 125 and the outermost side of the container 200 creates a sealing point 430 between the outermost side of the engaging wall 125 and the container 200 where the two structures meet. The sealing point 430 advantageously allows the closure member 100 to reseal to the container 200 even after the breakaway strip 120 has been separated from the skirt 110.

Figure 5A:
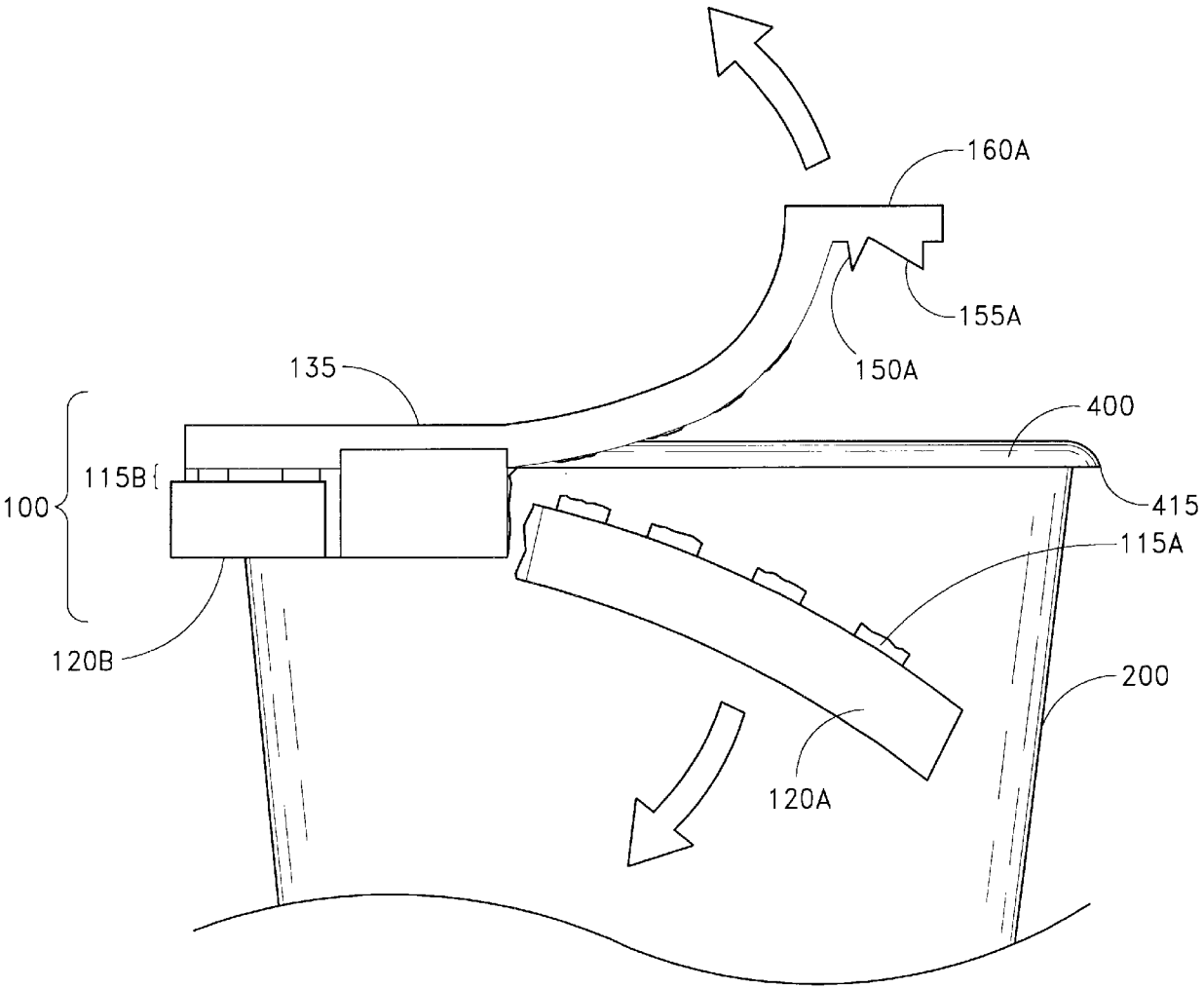
FIGS. 5A–5B illustrates side views of the closure member being disengaged from the container.
Figure 5B:
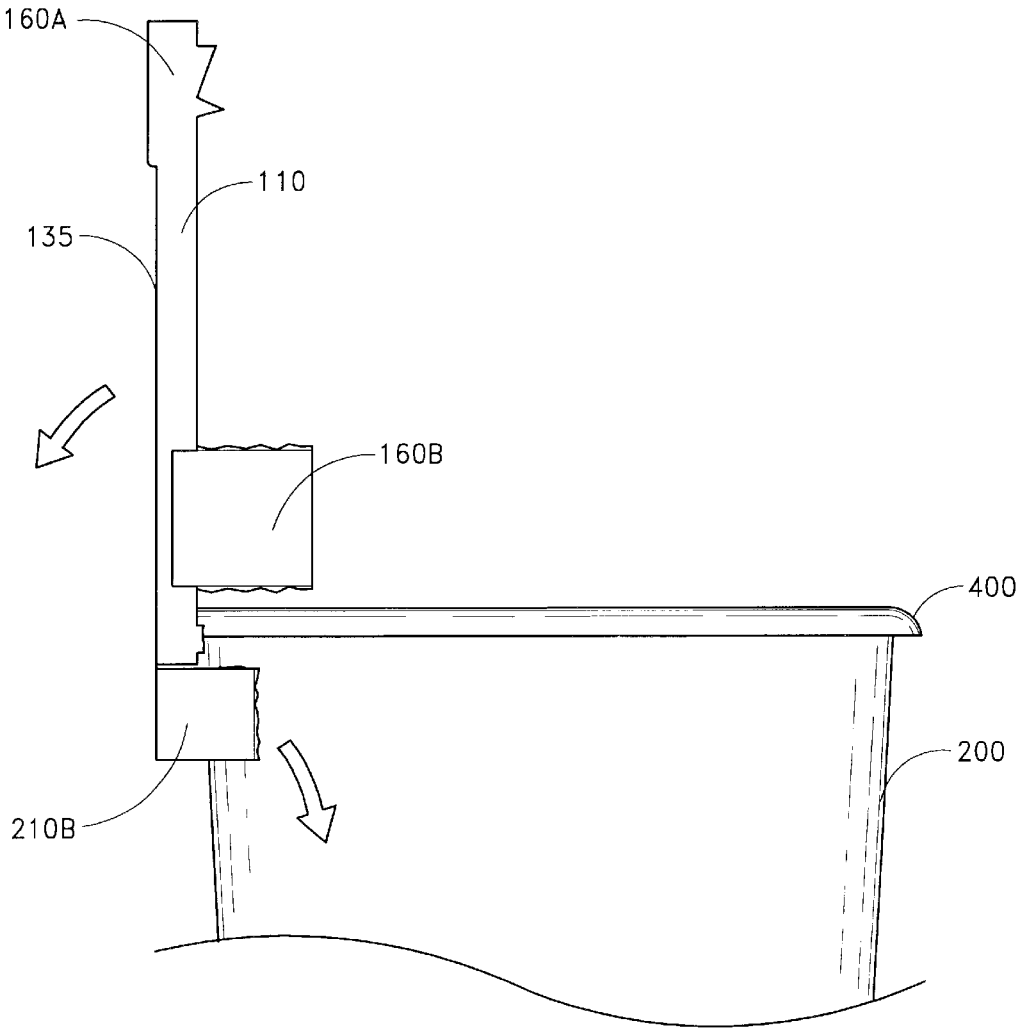

FIGS. 5A–5B illustrates side views of the closure member 100 being disengaged from the container 200, according to the preferred embodiment of the invention. In this embodiment, the skirt 110 includes three pull-tabs 160A, 160B, and 160C, circumferentially spaced between three breakaway strips 120A, 120B and 120C, each breakaway strip 120 having a corresponding perforated web 115A, 115B 115C, respectively. Accordingly, each pull-tab 160 corresponds with its clockwise-adjacent like-named perforated web 115 and breakaway strip 120. According to the preferred embodiment, the pull-tabs 160B and 160C are spaced substantially equidistant in opposite circumferential directions from the pull-tab 160A. According to one alternative embodiment (not shown), the pull-tabs 160B and 160C preferably range from 90 degrees to 170 degrees away from the pull-tab 160A. More preferably, the pull-tabs 160B and 160C are approximately 115 degrees to 125 degrees away from the pull-tab 160A.

FIG. 5A illustrates the closure member 100 as it is partially disengaged from the rim 400 of the container 200. According to FIG. 5A, stress is applied in an upwardly direction to the bottom of the pull-tab 160A when the user pulls upwardly on the pull-tab 160A. The pull-tab 160A hinges outwardly, breaking away from the perforated webs 115A and 115C at their vertical indicators 215. As continued upward stress is applied to the pull-tab 160A, the reinforcement of the pull-tab 160A raises the top surface 135 of the skirt 110. As mentioned, the upper protrusion 150 on the breakaway strips 120A and 120C lock against the annular tip 415 of the rim 400. Thus, as the closure member 100 is raised, the breakaway strips 120A and 120C remain locked underneath the annular tip 415, thereby breaking the weakened sections 137 and separating the skirt 110 from the breakaway strips 120A and 120C.

According to one embodiment, the upward stress on the pull-tab 160A and the spacing of the pull-tabs 160B and 160C, forces the pull-tabs 160B and 160C inward toward the container 200. This inward motion tightens the engagement of the upper protrusion 150 of the pull-tabs 160B and 160C to the annular tip 415 of the rim 400 of the container 200. This action temporarily affixes the pull-tabs 160B and 160C to the annular tip 415 such that further stress is applied between the skirt 110 and the breakaway strips 120A and 120C. This further stress advantageously separates the skirt 110 from the breakaway strips 120A and 120C, without necessitating that the user manually pull the breakaway strips 120 off from the skirt 110. Thus, according to the preferred embodiment, the user separates the closure member 100 from the container 200 in a single motion. Preferably, this single motion also completely separates the breakaway strips 120 from the skirt 110. However, in some instances, the user may still separate dangling portions of the breakaway strips 120 from the skirt 110.

As continued upward stress is applied to the pull-tab 160A, the engagement of the pull-tabs 160B and 160C is overcome and the skirt 110 between the pull-tabs 160B and 160C begins to rise off of the rim 400 of the container 200. However, as shown in FIG. 5B, even though the skirt 110 is nearly completely separated from the container 200, the upper protrusion 150 of the breakaway strip 120B remains locked underneath the annular tip 415 of the container 200. Thus, the skirt 110 hinges at, and eventually breaks away from the breakaway strip 120B, near its center.

Figure 6:
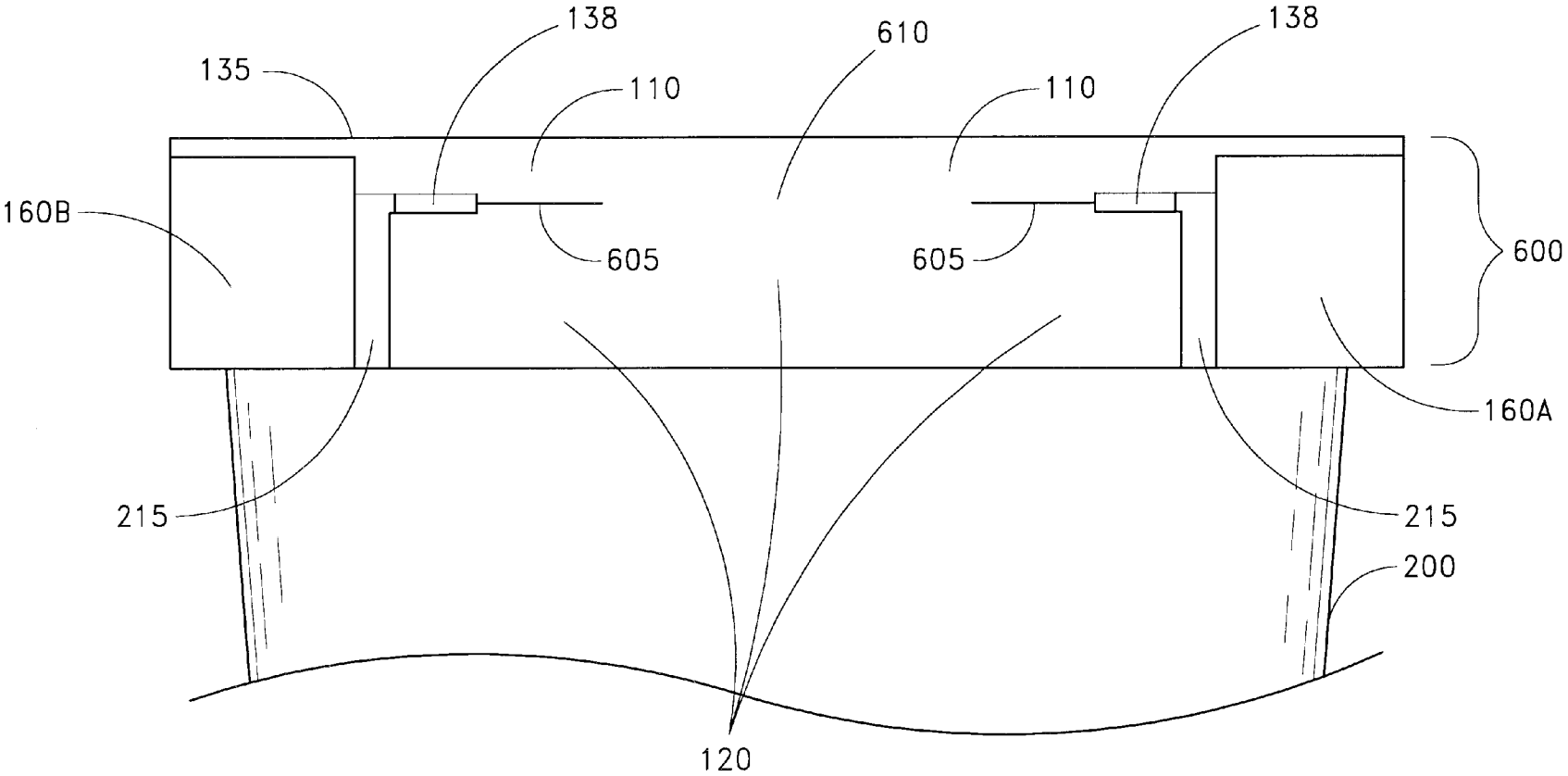
FIG. 6 illustrates a front elevation view of a closure member engaged to the container according to another embodiment of the invention.

FIG. 6 illustrates a front elevational view of a closure member 600 engaged to the container 200 according to another embodiment of the invention. The closure member 600 of FIG. 6 is similar to the closure member 100 of FIG. 2 in that in their respective preferred embodiments, both the closure member 100 and the closure member 600 include three pull-tabs 160A, 160B, and 160C. However, the front elevational view of FIG. 2 differs from that of FIG. 6 in that the front elevational view of FIG. 6 is rotated so as to highlight various distinctive features of this embodiment.

Accordingly, FIG. 6 illustrates the closure member 600 having the skirt 110 having the top surface 135. In addition, FIG. 6 shows the pull-tabs 160A and 160B each surrounded by the vertical indicators 215, and firmly connected to the skirt 110 near the top surface 135. As mentioned in the foregoing, when stress is applied to one of the pull-tabs 160, that pull-tab 160 hinges near the top surface 135 of the skirt 110 while breaking though the vertical indicators 215. This stress is thus advantageously transferred to the skirt 110, thereby enabling the separation of the closure member 600 from the container 200 in the single motion of lifting the pull-tab 160.

FIG. 6 also illustrates open sections 138 adjacent to the vertical indicators 215. Having the open sections 138 adjacent to the vertical indicators 215 advantageously weakens the vertical indicators 215 such that when one of pull-tabs 160 is raised, the vertical indicators 215 are easily broken.

FIG. 6 also illustrates the closure member 600 having the breakaway strips 120. The breakaway strip 120 attaches to the skirt 110 via a weakened section 605 and a fixed section 610. In addition, the breakaway strip 120 attaches to the pull-tabs 160A and 160B via the vertical indicators 215. According to this embodiment, the weakened section 605 comprises frangible, thinned, or otherwise perforated material such that stress applied to the skirt 110 separates the breakaway strip 120 from the skirt 110 at the weakened section 605. In addition, the fixed section 610 comprises an extension of the skirt fastened in a fixed manner to the breakaway strip 120, thereby creating a non-frangible connection between the breakaway strip 120 and the skirt 110.

According to the preferred embodiment, the inner surface 140 of the breakaway strip 120 corresponding to the fixed section 610 does not include the upper protrusion 150. By not including the upper protrusions 150 in the fixed section 610, the breakaway strip 120 corresponding to the fixed section 610 does not engage the annular tip 415 of the container 200, and thereby does not inhibit removal of the closure member 600. As with the foregoing embodiment illustrated in FIG. 2, the closure member 600 of FIG. 6 can be advantageously removed in a single motion from the container 200. However, according to this embodiment, the breakaway strips 120 also advantageously remain attached to the skirt 110 at the fixed sections 610.

Although the foregoing invention has been described in terms of preferred embodiments, other embodiments will be apparent to those of ordinary skill in the art. For example, the perforated web 115 may comprise a break line, a score, or simply weakened material without gaps or the open sections 138. In addition, the container 200 may include ridges, protrusions, or angles on the inner surface 405 before the rim 400 such that the resealability between the engaging wall 125 and the container 200 is improved.

It will also be apparent that a skilled artisan may advantageously employ differing shaped pull-tabs 160 to further enhance the functionality discussed in the foregoing description. Additionally, other combinations, omissions, substitutions and modifications will be apparent to the skilled artisan in view of the foregoing disclosure. Accordingly, the present invention is not intended to be limited by the recitation of the embodiments, but is instead to be defined by the appended claims.

What is claimed is:

1. A closure member comprising:

a center section configured to cover a container;

a skirt surrounding the center section;

a plurality of non-continuous breakaway strips;

a frangible web for attaching the skirt to the breakaway strips;

a plurality of pull-tabs formed on the skirt, wherein each pull-tab is positioned between adjacent breakaway strips; and at least one protruding edge on each of the breakaway strips, the protruding edge configured to provide single motion separation of the breakaway strips from the skirt when one of the pull-tabs is lifted upwardly.

2. The closure member according to claim 1, wherein the plurality of pull-tabs includes a first, second and third pull-tab, and wherein the second pull-tab is spaced at least 90 degrees in a counter-clockwise direction from the first pull-tab, and the third pull-tab is spaced at least 90 degrees in a clockwise direction from the first pull-tab.

3. The closure member according to claim 1, wherein the plurality of pull-tabs includes a first, second and third pull-tab, and wherein the second pull-tab is spaced between 115 and 125 degrees in a counter-clockwise direction from the first pull-tab, and the third pull-tab is spaced between 115 and 125 degrees in a clockwise direction from the first pull-tab.

4. The closure member according to claim 1, wherein the frangible web includes weakened sections alternating with open sections.

5. A reclosable container comprising:

a container having an inverted U-shaped annular rim terminating at a tip; and a lid having a center section, a skirt formed at the periphery of the center section and configured to engage the rim of the container, and a plurality of strips frangibly attached to the skirt, wherein each strip includes an inner edge configured to engage the tip of the rim such that a single motion separates the skirt from the strips and the lid from the container.

6. The reclosable container according to claim 5, wherein the lid further comprises a perforated web attaching the plurality of strips to the skirt.

7. The reclosable container according to claim 6, wherein the perforated web includes weakened sections alternating with open sections.

8. The reclosable container according to claim 5, wherein the lid further comprises a plurality of pull-tabs spaced between the plurality of strips, wherein each pull-tab is fixedly attached to the skirt such that lifting upwardly on one pull-tab separates the skirt from the strips and the lid from the container.

9. A closure member comprising:

a cover section configured to cover an open end of a container; and a skirt surrounding the cover section and having a plurality of pull-tabs circumferentially spaced around the periphery of the skirt, each pull-tab being of a thicker cross section than that of the skirt and each pull-tab having at least one protrusion configured to engage an edge of an a rim of a container so as to attach the closure member to the container.

10. The closure member according to claim 9, wherein the plurality of pull-tabs includes a first, second and third pull-tab, and wherein the second pull-tab is spaced at least 90 degrees in a counter-clockwise direction from the first pull-tab, and the third pull-tab is spaced at least 90 degrees in a clockwise direction from the first pull-tab.

11. A closure member comprising:

a center section configured to cover an open end of a container, the open end of the container terminating in an outermost tip;

a skirt surrounding the center section and having an inverted U-shaped cross section, the inverted U-shaped cross section having a first wall connected to the center section and a second wall opposite the first wall;

at least one pull-tab attached the second wall; and at least one breakaway strip adjacently attached to the pull-tab via vertical indicators and attached to the skirt via a perforated web, the breakaway strip having a first protrusion configured to engage the container at the outermost tip such that the vertical indicators, the perforated web, and the breakaway strips form a tamper evidencing mechanism, wherein the closure member further comprises three pull-tabs, each pull-tab having a pull-tab protrusion substantially similar to the first protrusion on the breakaway strip.

12. The closure member of claim 11, wherein the closure member engages the container in a manner tending to lift the closure member off the container, thereby applying a force to the first protrusion and the pull-tab protrusion where they engage the container at the outermost tip.

13. The closure member of claim 11, wherein the breakaway strip further includes a second protrusion below the first protrusion, the second protrusion configured to enable use of the closure member in high speed capping machines.

14. The closure member of claim 1, wherein the perforated web comprises weakened section alternating with open sections.

15. A closure member comprising:

a center section configured to cover an open end of a container;

a skirt surrounding the center section;

a plurality of breakaway strips configured to prevent tampering;

a plurality of weakened sections, each weakened section frangibly connecting at least a portion of each the breakaway strip to the skirt; and at least one pull-tab fixedly attached to the skirt and frangibly attached between breakaway strips such that a user lifting on the pull-tab separates the closure member from the container in a single motion.

16. The closure member according to claim 15, wherein the at least one pull-tab is frangibly attached between breakaway strips via vertical indicators configured to prevent tampering.

17. The closure member according to claim 15, wherein portions of the breakaway strips are fixedly attached to the skirt such that only the portions of the breakaway strips frangibly attached to the skirt by the weakened sections separate from the skirt when the closure member is removed from the container.

18. The closure member according to claim 15, wherein the breakaway strips are entirely frangibly attached to the skirt by the weakened sections such that the breakaway strips separate from the skirt when the closure member is removed from the container.

* * * * *